US012697531B2

(12) United States Patent
Sood

(10) Patent No.: US 12,697,531 B2
(45) Date of Patent: Aug. 4, 2026

(54) GOLF PUTTER

(71) Applicant: Nakul Sood, Noida (IN)

(72) Inventor: Nakul Sood, Noida (IN)

(73) Assignee: INCRED GOLF INCORPORATED, Albertson, NY (US)

( * ) Notice: Subject to any disclaimer, the term of this patent is extended or adjusted under 35 U.S.C. 154(b) by 438 days.

(21) Appl. No.: 18/371,291

(22) Filed: Sep. 21, 2023

(65) Prior Publication Data

US 2025/0099819 A1 Mar. 27, 2025

(51) Int. Cl.
*A63B 53/00* (2015.01)
*A63B 53/02* (2015.01)
*A63B 53/04* (2015.01)

(52) U.S. Cl.
CPC ..... *A63B 53/007* (2013.01); *A63B 53/021* (2020.08); *A63B 53/0408* (2020.08); *A63B 53/0487* (2013.01)

(58) Field of Classification Search
CPC ..... A63B 2053/0491; A63B 53/007; A63B 53/021; A63B 53/0487
See application file for complete search history.

(56) References Cited

U.S. PATENT DOCUMENTS 4,702,477 A * 10/1987 Solomon ..... A63B 53/007 473/313
5,390,919 A * 2/1995 Stubbs ..... A63B 53/065 473/292
5,494,282 A * 2/1996 Pranio ..... A63B 53/0487 473/340
5,685,784 A 11/1997 Butler
5,938,538 A 8/1999 Broadbridge et al.
6,095,931 A * 8/2000 Hettinger ..... A63B 60/02 473/341
6,435,976 B1 * 8/2002 Galliers ..... A63B 53/0487 473/251
7,435,188 B2 10/2008 Tateno et al.
12,496,500 B2 * 12/2025 Demkowski ..... A63B 53/065
2025/0099819 A1 * 3/2025 Sood ..... A63B 53/02

OTHER PUBLICATIONS

International Search Report and Written Opinion for corresponding International Appl. No. PCT/IN2024/051694 mailed Dec. 20, 2024.

* cited by examiner

*Primary Examiner* — Christopher R Legendre
(74) *Attorney, Agent, or Firm* — Farber LLC

(57) ABSTRACT

A golf putter includes a putter head and a shaft. The putter head includes a toe end and a heel end, a putter face, a first part, a pair of connecting pins, and a second part. The second part is coupled to the first part via the pair of connecting pins such that the putter head defines a center of gravity of the putter head in a plane that is parallel to a vertical plane containing the putter face and that passes through the pair of connecting pins. Further, a bottom end of the shaft is coupled to the second part of the putter head at a contact point that lies between the toe end and the heel end of the putter head and that lies behind the center of gravity with reference to the putter face, and a top end of the shaft is inclined towards the vertical plane.

16 Claims, 11 Drawing Sheets

GOLF PUTTER

TECHNICAL FIELD

The present disclosure relates to the field of golf clubs. More Particularly, the present disclosure relates to golf putters.

BACKGROUND

The information in this section merely provides background information related to the present disclosure and may not constitute prior art(s) for the present disclosure.

The popularity of golf has created a strong demand for golf equipment and other related products and services. Equipment makers continue to research and develop new golf club designs to attract the golf players/consumers. One area of this research and development focuses on the design of putters' features for aiming, sighting, and alignment of the putter with the object of ensuring that the golf ball travels in the desired direction when putted.

Different kinds and styles of golf putters exist in the market. Also, golf putters have to be deemed legal by the governing bodies of golf, for example, the USGA (the United States Golf Association) or the R&A (the Royal & Ancient Golf Club of St Andrews). The vast majority of said golf putters available in the market are heel mounted, face up or toe hang putters, for example, the Ping Anser golf putter, the blade putter, the mallet putter, etc. However, all of these putters exhibit the same properties, such as their shafts are heel mounted, the weight of the putter is behind the shaft, and when the shaft is held parallel to the ground, the face of the putter either points to the sky (i.e., Face Balanced Putter) or the toe hangs at a slight angle to the sky (i.e., Toe Hang Putter).

Further, while centre shafted putters are available in the market; however, the said centre shafted putters are also either Face Balanced or Toe Hang, with the majority of the mass/weight of the putter behind the shaft.

All of the above discussed golf putter designs/styles and other conventional known golf putters perform in a similar fashion and requires the golf player to control a movement of hands to make a good stroke on the golf ball to send the golf ball straight at the aimed target. A good stroke in putting is one where the strike imparted on the golf ball is square or perfectly perpendicular to the target. It can thus be contemplated that the known golf putters are not ergonomic, and the golf player faces challenges to move the golf putter through the air and to deliver square or perfectly perpendicular strike at the golf ball.

Accordingly, there remains a need in the domain to provide a golf putter that addresses and overcomes the technical problems identified above.

SUMMARY

The one or more shortcomings of the prior art are overcome by the apparatus/device as claimed, and additional advantages are provided through the provision of the apparatus/device as claimed in the present disclosure. Additional features and advantages are realized through the techniques of the present disclosure. Other embodiments and aspects of the disclosure are described in detail herein and are considered a part of the claimed disclosure.

Pursuant to an aspect of the present disclosure, in an embodiment, a golf putter is disclosed. The golf putter comprises a putter head and a shaft. The putter head comprises a toe end and a heel end, a putter face adapted to strike a golf ball, a first part made of a first material and having a first mass, a second part made of a second material and having a second mass, and a pair of connecting pins made of the first material. The second part is coupled to the first part via the pair of connecting pins such that the putter head defines a center of gravity of the putter head in a central plane that is parallel to a vertical plane containing the putter face and that passes through the pair of connecting pins. The shaft has a top end and a bottom end. The bottom end of the shaft is coupled to the second part of the putter head at a contact point that lies between the toe end and the heel end of the putter head and that lies behind the center of gravity of the putter head with reference to the putter face. Further, the top end of the shaft is inclined towards the vertical plane.

In another non-limiting embodiment of the present disclosure, a longitudinal axis of the shaft defines a forward press angle with respect to the central plane. The forward press angle is within the range of 1 to 4 degrees.

In another non-limiting embodiment of the present disclosure, the longitudinal axis of the shaft is inclined towards the heel end of the putter head and defines a lie angle with respect to a transverse plane that is perpendicular to the central plane. The lie angle is within the range of 67 to 79 degrees.

In another non-limiting embodiment of the present disclosure, the contact point is defined mid-way between the toe end and the heel end of the putter head.

In another non-limiting embodiment of the present disclosure, the center of gravity is defined between the putter face and the contact point.

In another non-limiting embodiment of the present disclosure, the putter head further comprises a connecting element for coupling the shaft of the golf putter to the putter head of the golf putter.

In another non-limiting embodiment of the present disclosure, the pair of connecting pins press-fits into corresponding holes defined in the first part and the second part of the putter head.

In another non-limiting embodiment of the present disclosure, the central plane is proximal to the first part of the putter head than the contact point of the shaft and the putter head.

In another non-limiting embodiment of the present disclosure, the central plane passes through the first part of the putter head.

In another non-limiting embodiment of the present disclosure, the top end of the shaft extends upto a top edge of the putter face of the putter head.

In another non-limiting embodiment of the present disclosure, the top end of the shaft extends beyond a top edge of the putter face of the putter head.

In another non-limiting embodiment of the present disclosure, the first part and the pair of connecting pins of the putter head are made of steel, brass or copper. Further, the second part of the putter head is made of aluminum or plastic.

In another non-limiting embodiment of the present disclosure, the second part comprises two columnar legs connected to each other via a bridging member. The bridging member is adapted to be coupled to the first part. The second part is coupled to the first part such that the center of gravity of the putter head lies between the contact point and the putter face.

In another non-limiting embodiment of the present disclosure, a length of the putter head is within the range of 50 mm to 125 mm, a width of the putter head is within the range of 30 mm to 120 mm and a height of the putter head is within the range of 15 mm to 45 mm.

In another non-limiting embodiment of the present disclosure, the second part is formed in the shape of a 'cuboidal' block. The second part is coupled to the first part such that the center of gravity of the putter head lies between the contact point and the putter face.

In another non-limiting embodiment of the present disclosure, a length of the putter head is within the range of 50 mm to 125 mm, a width of the putter head is within the range of 15 mm to 90 mm and a height of the putter head is within the range of 15 mm to 45 mm.

In another non-limiting embodiment of the present disclosure, the second part is formed in the shape of a 'tuning fork' comprising two columnar legs. The two columnar legs are adapted to be coupled to the first part. The second part is coupled to the first part such that the center of gravity of the putter head lies between the contact point and the putter face.

In another non-limiting embodiment of the present disclosure, a length of the putter head is within the range of 50 mm to 125 mm, a width of the putter head is within the range of 30 mm to 120 mm and a height of the putter head is within the range of 15 mm to 45 mm.

Pursuant to another aspect of the present disclosure, in an embodiment, a golf putter is disclosed. The golf putter comprises a putter head and a shaft. The putter head comprises a center of gravity defined on an origin of a cartesian coordinate system, where the origin corresponds to $x=0$, $y=0$, $z=0$. The putter head further comprises a toe end and a heel end having values $x>0$ and $x<0$, respectively, and a putter face adapted to strike a golf ball and the putter face having an $x<0$. The putter head furthermore comprises a first part made of a first material and having a first mass, a second part made of a second material and having a second mass, and a pair of connecting pins made of the first material. The second part is coupled to the first part via the pair of connecting pins such that the putter head defines the center of gravity of the putter head. Further, the shaft has a top end and a bottom end. The bottom end of the shaft is coupled to the second part of the putter head at a contact point such that the contact point has a value $x>0$, and the top end of the shaft has a value $x<0$.

Pursuant to yet another aspect of the present disclosure, in an embodiment, a putter head for a golf putter is disclosed. The golf putter comprises a shaft adapted to be coupled to the putter head. The putter head comprises a toe end and a heel end, a putter face adapted to strike a golf ball, a first part made of a first material and having a first mass, a second part made of a second material and having a second mass, and a pair of connecting pins made of the first material. The second part is coupled to the first part via the pair of connecting pins such that the putter head defines a center of gravity of the putter head in a central plane that is parallel to a vertical plane containing the putter face and that passes through the pair of connecting pins. Further, the second part of the putter head is couplable to the shaft of the golf putter such that a bottom end of the shaft is coupled to the putter head at a contact point that lies between the toe end and the heel end of the putter head and that lies behind the center of gravity of the putter head with reference to the putter face, and a top end of the shaft is inclined towards the vertical plane.

The golf putter and the putter head of the present disclosure possess the properties that overcomes the technical problems identified in the conventional/known golf putters. The golf putter and the putter head of the present disclosure are center shafted, forward press (i.e., the shaft leans forward towards the target/golf ball and up to or beyond the putter face of the putter head), heavily front weighted (the majority weight/mass of the putter head is ahead of the shaft/contact point), a face down or sky dive when held parallel to the ground and with the shaft attached to the putter head via pyramidical or a cylindrical connecting element at an angle to the putter face.

The above recited configuration of the golf putter and the putter head along with a combination of various design and physical factors, balance and choice of materials results in certain properties in the putter head that while not creating a 'larger sweet spot' result in the putter flowing on a more correct plane or arc which results in an easier stroke to strike the golf ball. The sweet spot may be understood as an area on the putter face where impact produces little or no vibration. The golf putter of the present disclosure performs in such a way that the said golf putter creates an inertia that makes the golf putter stay on a plane or arc to deliver the face square at impact.

It is to be understood that the aspects and embodiments of the disclosure described above may be used in any combination with each other. Several of the aspects and embodiments may be combined together to form a further embodiment of the disclosure.

The foregoing summary is illustrative only and is not intended to be in any way limiting. In addition to the illustrative aspects, embodiments, and features described above, further aspects, embodiments, and features will become apparent by reference to the drawings and the following detailed description.

BRIEF DESCRIPTION OF FIGURES

The novel features and characteristics of the disclosure are set forth in the description. The disclosure itself, however, as well as a preferred mode of use, further objectives, and advantages thereof, will best be understood by reference to the following description of an illustrative embodiment when read in conjunction with the accompanying drawings. One or more embodiments are now described, by way of example only, with reference to the accompanying drawings wherein like reference numerals represent like elements and in which.

Figure 1:
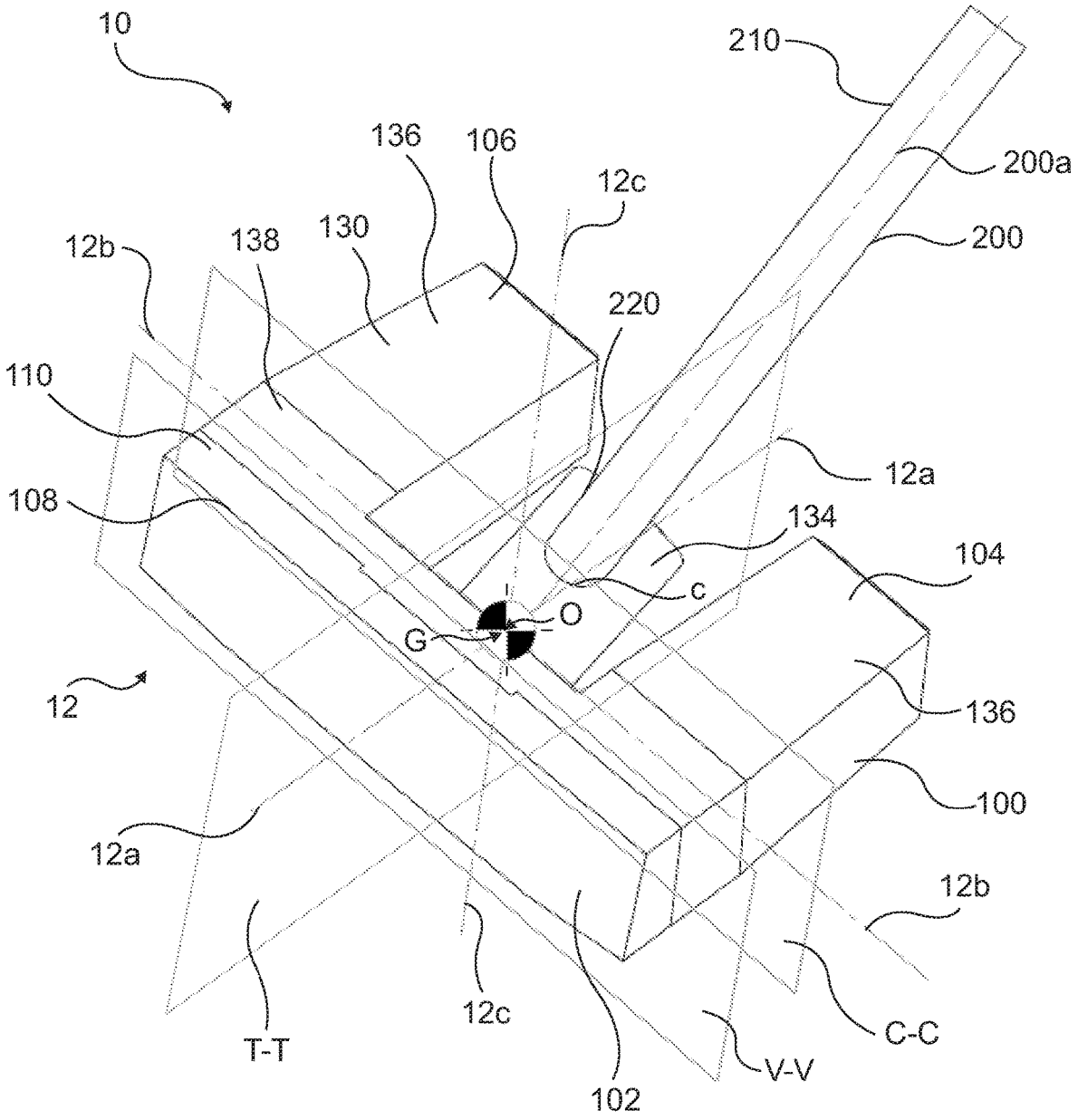
FIG. 1 illustrates a perspective view of an exemplary golf putter, in accordance with a first embodiment of the present disclosure.

Skilled artisans will appreciate that elements in the drawings are illustrated for simplicity and have not necessarily been drawn to scale. For example, the dimensions of some of the elements in the drawings may be exaggerated relative to other elements to help to improve understanding of embodiments of the present disclosure.

DETAILED DESCRIPTION

While the disclosure is susceptible to various modifications and alternative forms, specific embodiments thereof have been shown by way of example in the FIGS. and will be described in detail below. It should be understood, however that it is not intended to limit the disclosure to the particular forms disclosed, but on the contrary, the disclosure is to cover all modifications, equivalents, and alternatives falling within the scope of the disclosure as defined by the appended claims.

Before describing detailed embodiments, it may be observed that the novelty and inventive step that are in accordance with the present disclosure resides in a golf putter and a putter head of the golf putter. It is to be noted that a person skilled in the art can be motivated from the present disclosure and modify the various constructions of the golf putter and the putter head. However, such modification should be construed within the scope of the present disclosure. Accordingly, the drawings are showing only those specific details that are pertinent to understanding the embodiments of the present disclosure so as not to obscure the disclosure with details that will be readily apparent to those of ordinary skill in the art having benefit of the description herein.

In the present disclosure, the term "exemplary" is used herein to mean "serving as an example, instance, or illustration." Any embodiment or implementation of the present subject matter described herein as "exemplary" is not necessarily to be construed as preferred or advantageous over other embodiments.

The terms "comprises", "comprising", or any other variations thereof, are intended to cover a non-exclusive inclusions, such that a device that comprises a list of components does not include only those components but may include other components not expressly listed or inherent to such setup or device. In other words, one or more elements in a system or apparatus proceeded by "comprises . . . a" does not, without more constraints, preclude the existence of other elements or additional elements in the system or apparatus.

The terms like "at least one" and "one or more" may be used interchangeably or in combination throughout the description.

Pursuant to an embodiment of the present disclosure, a golf putter is disclosed. The golf putter comprises a putter head and a shaft. The putter head comprises a toe end and a heel end, a putter face adapted to strike a golf ball, a first part made of a first material and having a first mass, a second part made of a second material and having a second mass, and a pair of connecting pins made of the first material. The second part is coupled to the first part via the pair of connecting pins such that the putter head defines a center of gravity of the putter head in a central plane that is parallel to a vertical plane containing the putter face and that passes through the pair of connecting pins. The shaft has a top end and a bottom end. The bottom end of the shaft is coupled to the second part of the putter head at a contact point that lies between the toe end and the heel end of the putter head and that lies behind the center of gravity of the putter head with reference to the putter face. Further, the top end of the shaft is inclined towards the vertical plane. A longitudinal axis of the shaft defines a forward press angle with respect to the central plane. The forward press angle is within the range of 1 to 4 degrees. Further, the longitudinal axis of the shaft is inclined towards the heel end of the putter head and defines a lie angle with respect to a transverse plane that is perpendicular to the central plane. The lie angle is within the range of 67 to 79 degrees. The pair of connecting pins press-fits into corresponding holes defined in the first part and the second part of the putter head. Also, the center of gravity is defined between the putter face and the contact point.

In an embodiment, the first part and the pair of connecting pins of the putter head are made of steel, brass or copper. Further, the second part of the putter head is made of aluminum or plastic.

In one embodiment, the second part comprises two columnar legs connected to each other via a bridging member. The bridging member is adapted to be coupled to the first part. The second part is coupled to the first part such that the center of gravity of the putter head lies between the contact point and the putter face. A length of the putter head is within the range of 50 mm to 125 mm, a width of the putter head is within the range of 30 mm to 120 mm and a height of the putter head is within the range of 15 mm to 45 mm.

In another embodiment, the second part is formed in the shape of a 'cuboidal' block. The second part is coupled to the first part such that the center of gravity of the putter head lies between the contact point and the putter face. A length of the putter head is within the range of 50 mm to 125 mm, a width of the putter head is within the range of 15 mm to 90 mm and a height of the putter head is within the range of 15 mm to 45 mm.

In yet another embodiment, the second part is formed in the shape of a 'tuning fork' comprising two columnar legs. The two columnar legs are adapted to be coupled to the first part. The second part is coupled to the first part such that the center of gravity of the putter head lies between the contact point and the putter face. A length of the putter head is within the range of 50 mm to 125 mm, a width of the putter head is within the range of 30 mm to 120 mm and a height of the putter head is within the range of 15 mm to 45 mm.

Pursuant to another embodiment of the present disclosure, a golf putter is disclosed. The golf putter comprises a putter head and a shaft. The putter head comprises a center of gravity defined on an origin of a cartesian coordinate system, where the origin corresponds to $x=0$, $y=0$, $z=0$. The putter head further comprises a toe end and a heel end having values $x>0$ and $x<0$, respectively, and a putter face adapted to strike a golf ball and the putter face having an $x<0$. The putter head furthermore comprises a first part made of a first material and having a first mass, a second part made of a second material and having a second mass, and a pair of connecting pins made of the first material. The second part is coupled to the first part via the pair of connecting pins such that the putter head defines the center of gravity of the putter head. Further, the shaft has a top end and a bottom end. The bottom end of the shaft is coupled to the second part of the putter head at a contact point such that the contact point has a value x>0, and the top end of the shaft has a value x<0.

Pursuant to yet another embodiment of the present disclosure, a putter head for a golf putter is disclosed. The golf putter comprises a shaft adapted to be coupled to the putter head. The putter head comprises a toe end and a heel end, a putter face adapted to strike a golf ball, a first part made of a first material and having a first mass, a second part made of a second material and having a second mass, and a pair of connecting pins made of the first material. The second part is coupled to the first part via the pair of connecting pins such that the putter head defines a center of gravity of the putter head in a central plane that is parallel to a vertical plane containing the putter face and that passes through the pair of connecting pins. Further, the second part of the putter head is couplable to the shaft of the golf putter such that a bottom end of the shaft is coupled to the putter head at a contact point that lies between the toe end and the heel end of the putter head and that lies behind the center of gravity of the putter head with reference to the putter face, and a top end of the shaft is inclined towards the vertical plane.

The golf putter and the putter head of the present disclosure possess the properties that overcomes the technical problems identified in the conventional/known golf putters. The golf putter and the putter head of the present disclosure are center shafted, forward press (i.e., the shaft leans forward towards the target/golf ball and up to or beyond the putter face of the putter head), heavily front weighted (the majority weight/mass of the putter head is ahead of the shaft/contact point), a face down or sky dive when held parallel to the ground and with the shaft attached to the putter head via pyramidical or a cylindrical connecting element at an angle to the putter face.

The above recited configuration of the golf putter and the putter head along with a combination of various design and physical factors, balance and choice of materials results in certain properties in the putter head that while not creating a 'larger sweet spot' result in the putter flowing on a more correct plane or arc which results in an easier stroke to strike the golf ball. The sweet spot may be understood as an area on the putter face where impact produces little or no vibration. The golf putter of the present disclosure performs in such a way that the said golf putter creates an inertia that makes the golf putter stay on a plane or arc to deliver the face square at impact.

Reference will now be made to the exemplary embodiments of the disclosure, as illustrated in the accompanying drawings. Wherever possible, same numerals will be used to refer to the same or like parts. Embodiments of the disclosure are described in the following paragraphs with reference to FIGS. 1 to 11. In FIGS. 1 to 11, the same element or elements which have same functions are indicated by the same reference signs.

FIG. 1 illustrates an example of a golf putter 10 in accordance with an embodiment of the present disclosure. As is widely known and utilized, golf putters are golf clubs that are used in the sport of golf to make relatively short and low-speed strokes with the intention of rolling the ball into the hole. Golf putter is differentiated from the other clubs (typically irons and woods) by a club head with a very flat, low-profile, low-loft striking face, and by other features which are only allowed on golf putters, such as bent shafts, positional guides, etc. Golf putters are generally used from very close distances to the cup, generally on the putting green, though certain courses have fringes and roughs near the green which are also suitable for putting.

Figure 2:
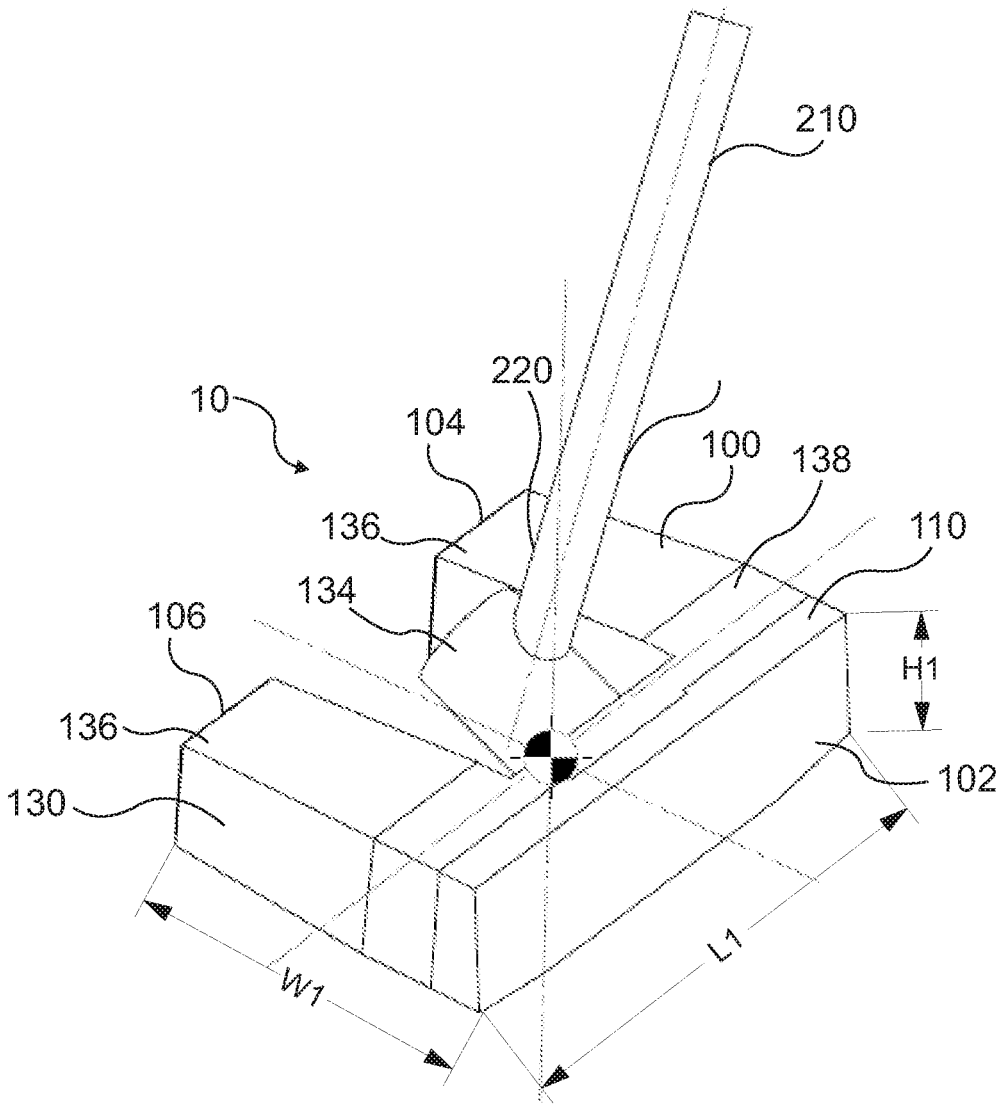
FIG. 2 illustrates another perspective view of the golf putter of FIG. 1, in accordance with an embodiment of the present disclosure.

FIGS. 1 and 2 show an artificial coordinate system 12 about a putter head 100 of the golf putter 10. The origin 'O' on the Cartesian coordinate system 12 (i.e., the position x=0, y=0, z=0) is the center of mass (center of gravity 'G') of the putter head 100 of the golf putter 10. In physics, the center of mass of a distribution of mass in space is the unique point where the weighted relative position of the distributed mass sums to zero. That is to say, the distribution of mass is balanced around the center of mass and the average of the weighted position coordinates of the distributed mass defines its coordinates.

The coordinate system 12 as discussed in FIGS. 1 and 2 includes an x-axis 12*a*, a y-axis 12*b* and a z-axis 12*c*. The x-axis 12*a* runs through the face 102 of the putter head 100. The face 102 of the golf head 100 has a negative 'x' position. The y-axis 12*b* is parallel to the face 102 of the golf head 100. That is, the y-axis 12*b* is parallel to a line drawn to the center of one side of the face 102 to the center of the other side of the face 102 (if the clubface is symmetrical), such that the 'y-z' plane (plane defined by the y-axis 12*b* and the z-axis 12*c*) is parallel to the face 102 of the golf head 100. A heel end 104 and a toe end 106 of the golf head 100 have negative and positive 'y' positions, respectively (vice versa for a left handed player). That is to say, the heel end 104 is always closest to the player (for a right handed player this is always a negative 'y' position, and for a left handed player this is always a positive 'y' position). The z-axis 12*c* runs vertically through the center of gravity 'G' of the golf head 100. The top of the golf putter 10 (for example, a top end of the shaft, grip, etc.) has a positive 'z' position, i.e., the top of the golf putter 10 is above the 'x-y' plane.

Figure 3:
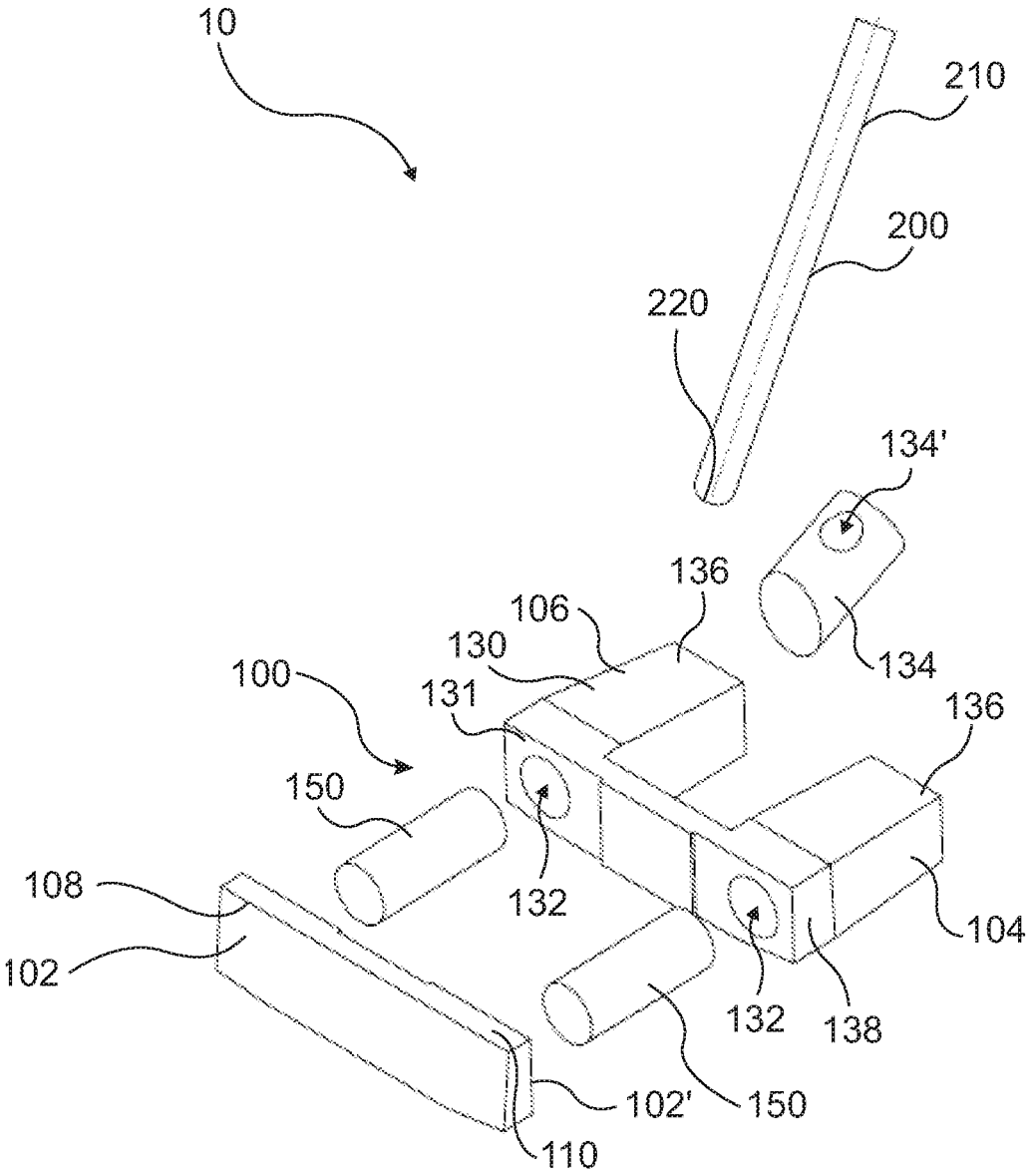
FIG. 3 is an exploded view of the golf putter of FIG. 1 comprising the different components, for example, a putter head, shaft, etc., in accordance with an embodiment of the present disclosure.

In accordance with the present disclosure, with reference to FIGS. 1, 2 and 3, the golf putter 10 comprises a putter head 100 and a shaft 200 that is adapted to be coupled to the putter head 100. As is widely known and discussed above, a combined assembly of the putter head 100 and the shaft 200, thereby making the golf putter 10, is used in the sport of golf to make relatively short and low-speed strokes with the intention of rolling the ball into the hole.

Still referring to FIGS. 1, 2 and 3, the putter head 100 comprises a toe end 104 and a heel end 106. It can be contemplated that the heel end 104 of the putter head 100 corresponds to the end that is closest to the golf player when the golf player is holding and aligning the golf putter 10 beside the golf ball to make a stroke. For example, FIG. 1 illustrates a 'right-handed' golf putter 10, and accordingly, the heel end 104 of the putter head 100 may be contemplated as the one having negative 'y' position. Therefore, the toe end 106 (opposite to the heel end 104) may be contemplated as the one having positive 'y' position. The putter head 100 further comprises a putter face 102 that is adapted to strike a golf ball. Referring to FIGS. 1 and 2, the putter face 102 may be contemplated as a face of the putter head 100 that extends across the heel end 104 and the toe end 106 of the putter head 100 and that has a negative 'x' position. Without limiting and deviating from the scope of protection of the present disclosure, in an embodiment, the putter face 102 is a flat, low-profile, low-loft striking face.

In accordance with the present disclosure, the putter head 100 is made of multiple parts, for example, a first part 110, a second part 130 and a pair of connecting pins 150. The pair of connecting pins 150 couples the second part 130 with the first part 110 of the putter head 100. Referring to FIG. 3, the first part 110 may be understood as a substantially cuboidal block made of a first material and having a first mass. As illustrated in FIGS. 1, 2 and 3, the first part 110 of the putter head 100 comprises the putter face 102. That is to say, the first part 110 of the golf head 100 comes in contact with the golf ball when a golf player employs the golf putter 10 to strike the golf ball. In an embodiment of the present disclosure, the first part 110 is made of metal. Further, the second part 130 of the putter head 100 may be understood as a part that has a positive 'x' position and is coupled to the first part 110 at a face opposite to the putter face 102. The second part 130 is made of a second material and has a second mass. In an embodiment, the second mass of the second part 130 is less than the first mass of the first part 110. The second mass of the second part 130 is chosen to be less than the first mass of the first part 110 such that the weight of the putter head 100, and thus the golf putter 10, is concentrated towards a forward portion of the putter head 100, i.e., the putter head 100 and the golf putter 10 are 'front-weighted'. In an exemplary embodiment, the first part 110 of the putter head 100 is made of steel, brass or copper. Also, in an exemplary embodiment, the second part 130 of the putter head 100 is made of aluminum or plastic.

The putter head 100 further comprises the pair of connecting pins 150 that is adapted to couple the second part 130 with the first part 110 of the putter head 100. The pair of connecting pins 150 may also be made of first material. In one embodiment of the present disclosure, the first part 110 may define a pair of blind holes (not visible) at the rear face 102' (visible in FIG. 3) (i.e., opposite to the putter face 102) thereof. Also, the second part 130 may also define a pair of blind holes 132 (visible in FIG. 3) at a face 131 that couples to the rear face of the first part 110. In said embodiment, the connecting pins 150 may be press-fitted into the corresponding blind holes 132 of the first part 110 and the second part 130 of the putter head 100 in order to couple the second part 130 with the first part 110 of the putter head 100. In another embodiment, the first part 110 of the putter head 100 may define a pair of 'pass-through' holes (not shown), each of which receives the corresponding connecting pin 150. An assembly of the first part 110 and the pair of connecting pins 150 is then machined to smoothen out the putter face 102 of the putter head 100 such that the putter face 102 defines a flat and continuous uniform surface. The free end of the connecting pins 150 may then be press-fitted into the corresponding blind holes 132 of the second part 130 of the putter head 100 in order to couple the second part 130 with the first part 110 of the putter head 100.

In an embodiment of the present disclosure, the pair of connecting pins 150 are also made of steel, brass or copper. Without deviating from the scope of the present disclosure, the second mass of the second part 130 is chosen to be less than a combined mass of the first part 110 and the pair of connecting pins 150 such that the weight of the putter head 100, and thus the golf putter 10, is concentrated towards the forward portion of the putter head 100, i.e., the putter head 100 and the golf putter 10 are 'front-weighted'. In accordance with the present disclosure, as illustrated in FIGS. 1 and 2, the center of gravity 'G' (i.e., the average location of the weight) of the putter head 100 (and thus the golf putter 10) lies in the forward region of the putter head 100. Without limiting the scope of the present disclosure, the center of gravity 'G' of the putter head 100 may be understood to lie in a central plane 'C-C'. The central plane 'C-C' is an imaginary plane that is parallel to a vertical plane 'V-V' containing the putter face 102 of the putter head 100 and that passes through the pair of connecting pins 150, when the putter head 100 is placed on a levelled ground. With reference to the coordinate system 12 illustrated in FIGS. 1 and 2, the central plane 'C-C' is an imaginary plane that passes through the Origin 'O' (x=0, y=0, z=0) of the coordinate system 12 and is parallel to the 'y-z' plane.

In an embodiment, the central plane 'C-C' containing the center of gravity 'G' of the putter head 100 passes through the first part 110 of the putter head 100, i.e., the center of gravity 'G' of the putter head 100 lies in the first part 110 of the putter head 100.

The golf putter 10 of the present disclosure further comprises the shaft 200 that is adapted to be coupled to the putter head 100. The shaft 200 comprises a top end 210 and a bottom end 220 opposite to the top end 210. The bottom end 220 of the shaft 200 may be coupled to the putter head 100 and the golf putter 10 and may be held by the golf player at the top end 210 of the shaft 200. The shaft 200 may comprise a gripping element (not shown) disposed on or coupled to the top end 210 of the shaft 200 for providing 'anti-slip' gripping surface, where the golf player may hold the golf putter 10. The shaft 200 further defines a longitudinal axis 200*a*, as shown in FIGS. 1, 2 and 3, that passes through the top end 210 and the bottom end 220 of the shaft 200.

In accordance with the present disclosure, the bottom end 220 of the shaft 200 is coupled to the second part 130 of the putter head 100 at a contact point 'C' defined at the putter head 100. Referring to FIGS. 1 and 2, the contact point 'C', i.e., the point where the shaft 200 is coupled to the putter head 100, lies behind the center of gravity 'G' of the putter head 100 with reference to the putter face 102. In other words, the center of gravity 'G' of the putter head 100 lies between the putter face 102 and the contact point 'C' defined at the putter head 100. With reference to the coordinate system 12 in which the Origin 'O' (x=0, y=0, z=0) of the coordinate system 12 corresponds to the reference point, the putter face 102 of the putter head 100 has a negative 'x' position and the contact point 'C' defined at the putter head 100 has a positive 'x' position. Further, the shaft 200 is coupled to the putter head 100 such that the contact point 'C' lies between the heel end 104 and the toe end 106 of the putter head 100. In an embodiment, the contact point 'C' is defined mid-way, with an error margin of 4 mm, between the heel end 104 and the toe end 106 of the putter head 100. Also, in some embodiment, the central plane 'C-C' containing the center of gravity 'G' is proximal to the first part 110 of the putter head 100 than the contact point 'C' of the shaft 200 and the putter head 100.

In an exemplary embodiment illustrated in FIGS. 1, 2 and 3, the putter head 100 comprises a connecting element 134 in the second part 130 of the putter head 100. The connecting element 134 may be a cylindrical or a pyramidical structure that defines a hole 134' (shown in FIG. 3) for coupling the bottom end 220 of the shaft 200 with the putter head 100 at the contact point 'C' defined at the putter head 100. In other exemplary embodiment, the connecting element 134 may be made of any other suitable shape that facilitates coupling the bottom end 220 of the shaft 200 with the second part 130 of the putter head 100. In other embodiments, the bottom end 220 of the shaft 200 may be coupled with the putter head 100 by any suitable means, for example, via industrial scale adhesive, press-fitting etc.

Figure 5:
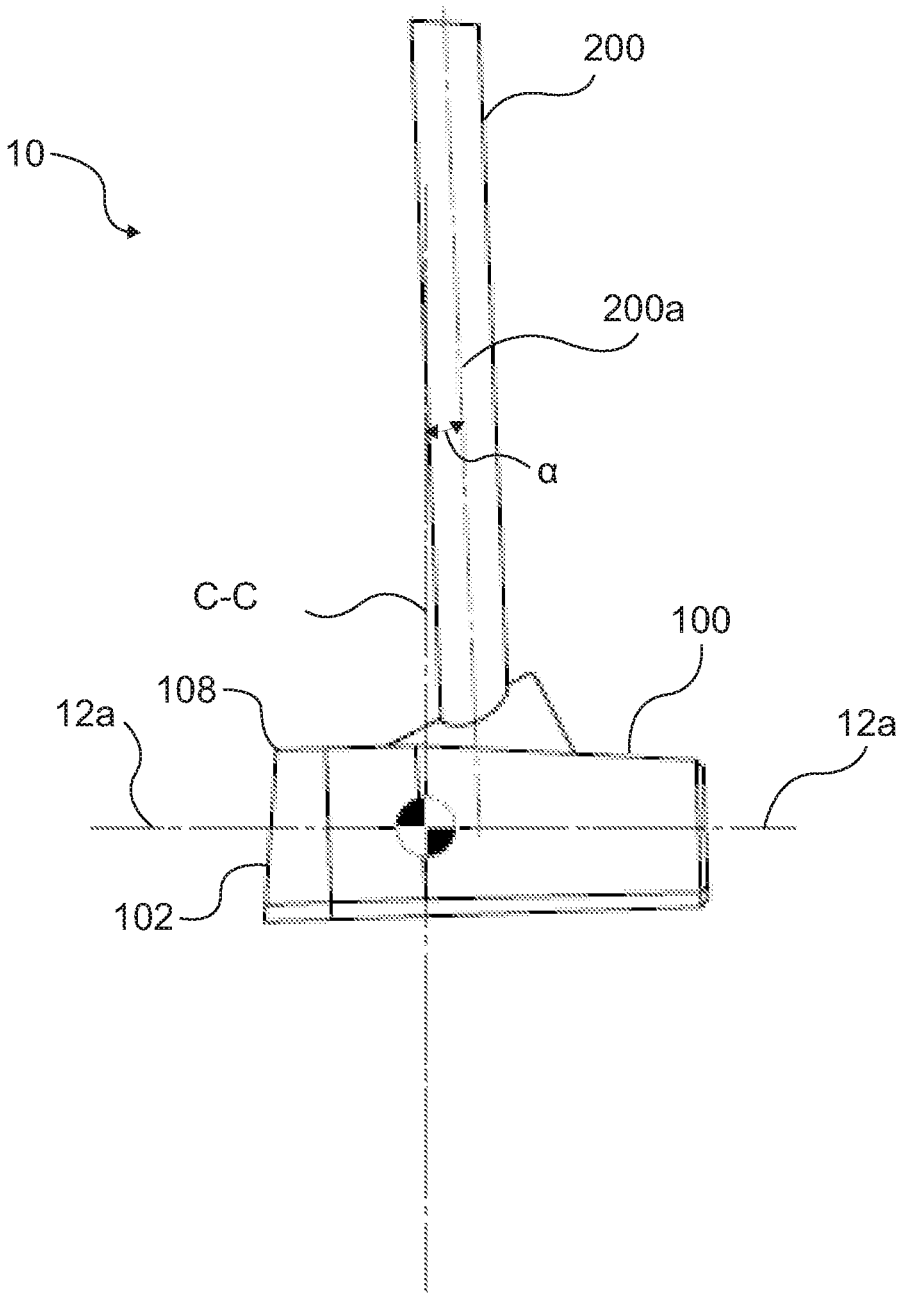
FIG. 5 is a side view of the golf putter of FIG. 1, in accordance with an embodiment of the present disclosure.

Further, the shaft 200 is coupled to the putter head 100 such that the top end 210 of the shaft 200 is inclined towards the putter face 102 of the putter head 100, i.e., the top end 210 of the shaft 200 is inclined towards the vertical plane 'V-V' containing the putter face 102. In accordance with the present disclosure, as shown in FIG. 5, the longitudinal axis 200*a* of the shaft 200 defines a forward press angle '$\alpha$' with respect to the central plane 'C-C'. With reference to the coordinate system 12, the top end 210 of the shaft 200 may have a negative 'x' position such that the top end 210 of the shaft 200 lies ahead of the center of gravity 'G' of the putter head 100. In one embodiment, the top end 210 of the shaft 200 extends upto a top edge 108 of the putter face 102, i.e., upto the vertical plane 'V-V' containing the putter face 102 of the putter head 100. In other embodiments, the top end 210 of the shaft 200 may extend beyond the top edge 108 of the putter face 102, i.e., beyond the vertical plane 'V-V' containing the putter face 102 of the putter head 100. In an embodiment, without limiting the scope of the present disclosure, the forward press angle 'α' may vary within the range of 1 to 4 degrees, measured with respect to the central plane 'C-C'. In a specific embodiment, the forward press angle 'α' may have a value of 2.5 degrees.

Figure 4:
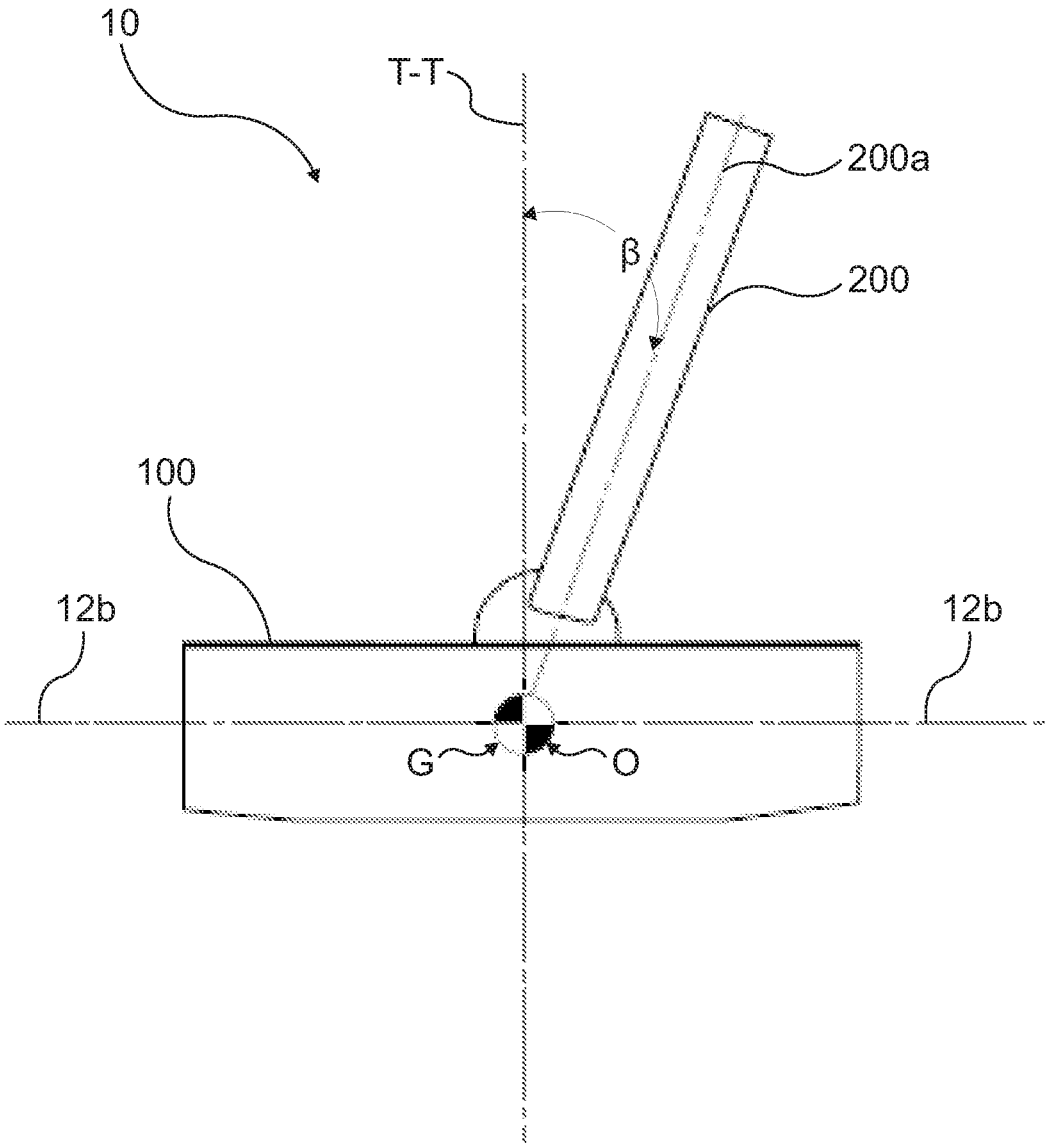
FIG. 4 is a front view of the golf putter of FIG. 1, in accordance with an embodiment of the present disclosure.

Also, in an embodiment, with reference to FIG. 4, the longitudinal axis 200*a* of the shaft 200 may be inclined towards the heel end 104 of the putter head 100 to define a lie angle 'β' with respect to a transverse plane 'T-T'. The transverse plane 'T-T' may be understood as an imaginary plane that is perpendicular to the central plane 'C-C' and the leveled ground surface, when the golf putter 10/the golf head 100 is held on the levelled ground surface. With reference to the coordinate system 12, the transverse plane 'T-T' may be understood as an imaginary plane that passes through the Origin 'O' (x=0, y=0, z=0) and is perpendicular to the y-axis 12*b*. Also, with reference to the coordinate system 12, the top end 210 of the shaft 200 may have a negative 'y' position. In an embodiment, without limiting the scope of the present disclosure, the lie angle 'β' may vary within the range of 67 to 79 degrees, measured with respect to the transverse plane 'T-T'. In a specific embodiment, the lie angle 'β' may have a value of 70 degrees.

In accordance with a first exemplary embodiment of the present disclosure, referring to FIGS. 1, 2, 4 and 5, the second part 130 of the putter head 100 may comprise a structure that is formed of two 'columnar' legs 136 connected to each other via a bridging member 138 such that the second part 130 has a 'C-shaped' structure. The bridging member 138 may define the pair of blind holes 132 therein. Said pair of blind holes 132 facilitates press-fitting the connecting pins 150 with the second part 130 such that the bridging member 138 (and accordingly, the second part 130) may be coupled with the first part 110 of the putter head 100. According to the said first exemplary embodiment, a size, material, and a mass of each of the first part 110, the second part 130 and the connecting pins 150, and the contact point 'C' at the putter head 100 are so selected that upon coupling the second part 130 to the first part 110 and the shaft 200 to the putter head 100, the center of gravity 'G' of the putter head 100 lies between the contact point 'C' and the putter face 102.

In accordance with the first exemplary embodiment, referring to FIG. 2, a length 'L1' of the putter head 100 may vary within the range of 50 mm to 125 mm, a width 'W1' of the putter head 100 may vary within the range of 30 mm to 120 mm and a height 'H1' of the putter head 100 may vary within the range of 15 mm to 45 mm. In a specific embodiment, the length 'L1' of the putter head 100 is 95 mm, the width 'W1' of the putter head 100 is 62 mm and the height 'H1' of the putter head 100 is 24 mm. Also, in said embodiment, the second part 130 comprises a 'cylindrical' connecting element 134 to couple the bottom end 220 of the shaft 200 with the second part 130 of the putter head 100 at the contact point 'C'.

Figure 6:
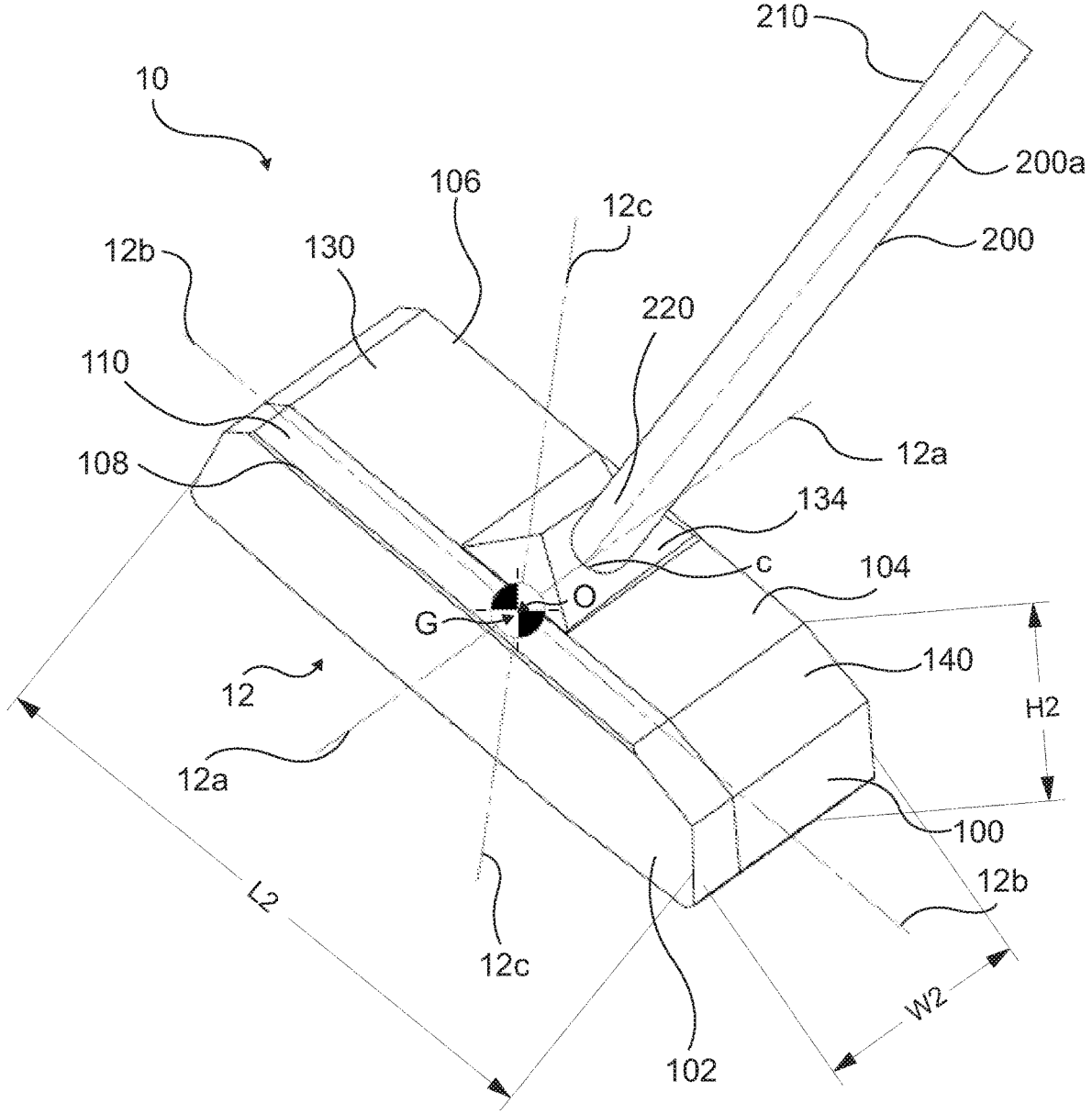
FIG. 6 illustrates a perspective view of an exemplary golf putter, in accordance with a second embodiment of the present disclosure.
Figure 7:
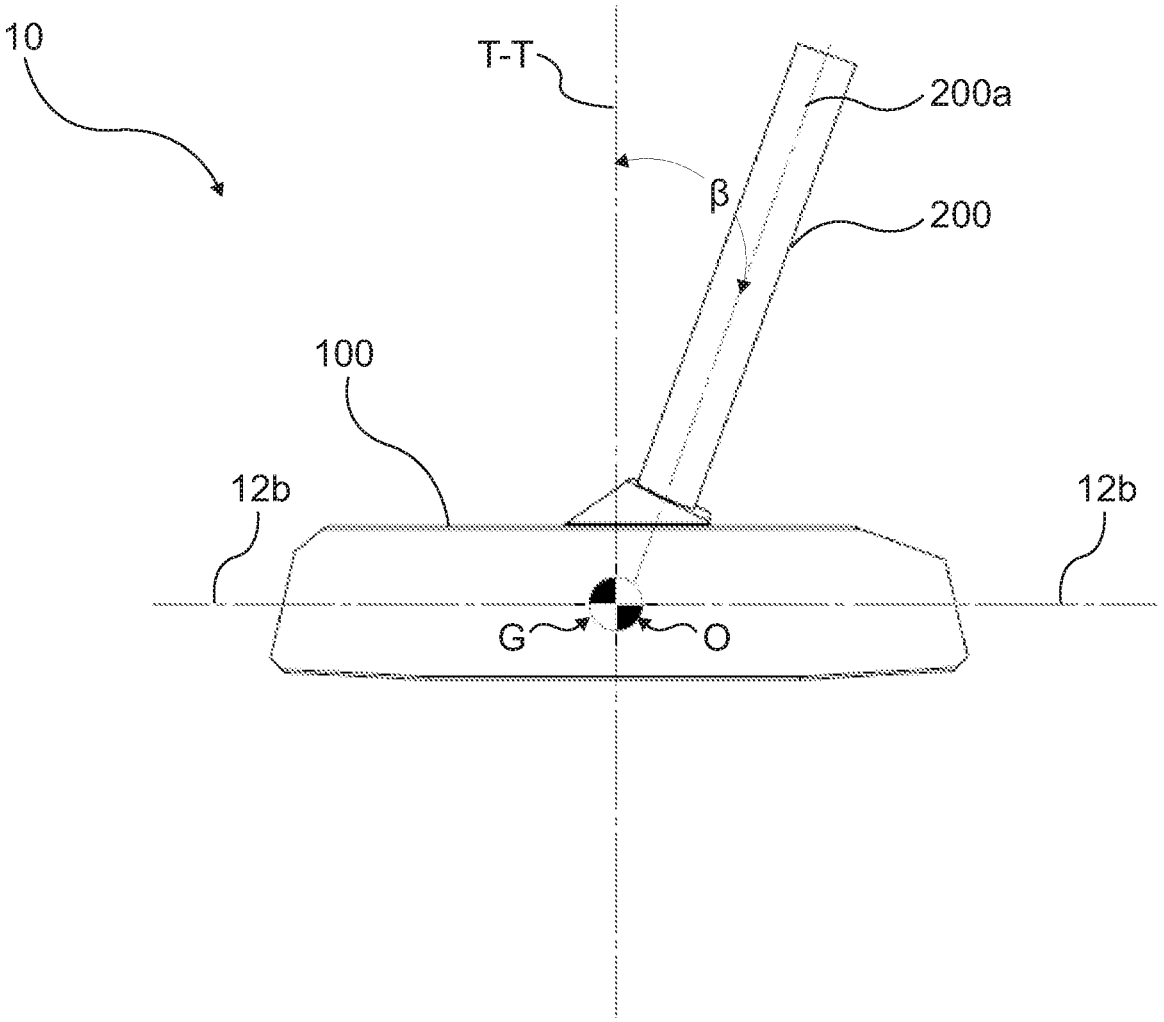
FIG. 7 is a front view of the golf putter of FIG. 6, in accordance with an embodiment of the present disclosure.
Figure 8:
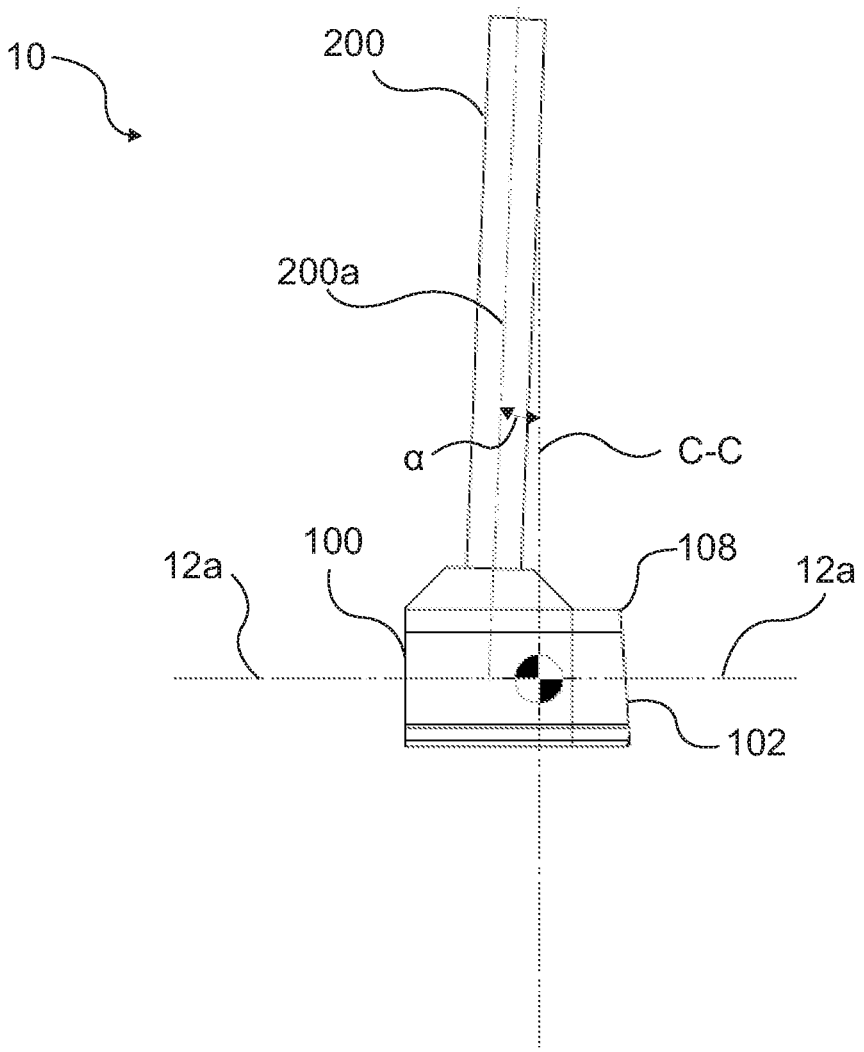
FIG. 8 is a side view of the golf putter of FIG. 6, in accordance with an embodiment of the present disclosure.

In accordance with a second exemplary embodiment of the present disclosure, referring to FIGS. 6, 7 and 8, the second part 130 of the putter head 100 may be formed in the shape of a 'cuboidal' block 140. A side of the cuboidal clock may define the pair of blind holes 132 therein. Said pair of blind holes 132 facilitates press-fitting the connecting pins 150 with the second part 130 such that the second part 130 may be coupled with the first part 110 of the putter head 100. According to the said second exemplary embodiment, a size, material, and a mass of each of the first part 110, the second part 130 and the connecting pins 150, and the contact point 'C' at the putter head 100 are so selected that upon coupling the second part 130 to the first part 110 and the shaft 200 to the putter head 100, the center of gravity 'G' of the putter head 100 lies between the contact point 'C' and the putter face 102.

In accordance with the second exemplary embodiment, referring to FIG. 6, a length 'L2' of the putter head 100 may vary within the range of 50 mm to 125 mm, a width 'W2' of the putter head 100 may vary within the range of 15 mm to 90 mm and a height 'H2' of the putter head 100 may vary within the range of 15 mm to 45 mm. In a specific embodiment, the length 'L2' of the putter head 100 is 107 mm, the width 'W2' of the putter head 100 is 40 mm and the height 'H2' of the putter head 100 is 24 mm. Also, in said embodiment, the second part 130 comprises a 'pyramidical' connecting element 134 to couple the bottom end 220 of the shaft 200 with the second part 130 of the putter head 100 at the contact point 'C'.

Figure 9:
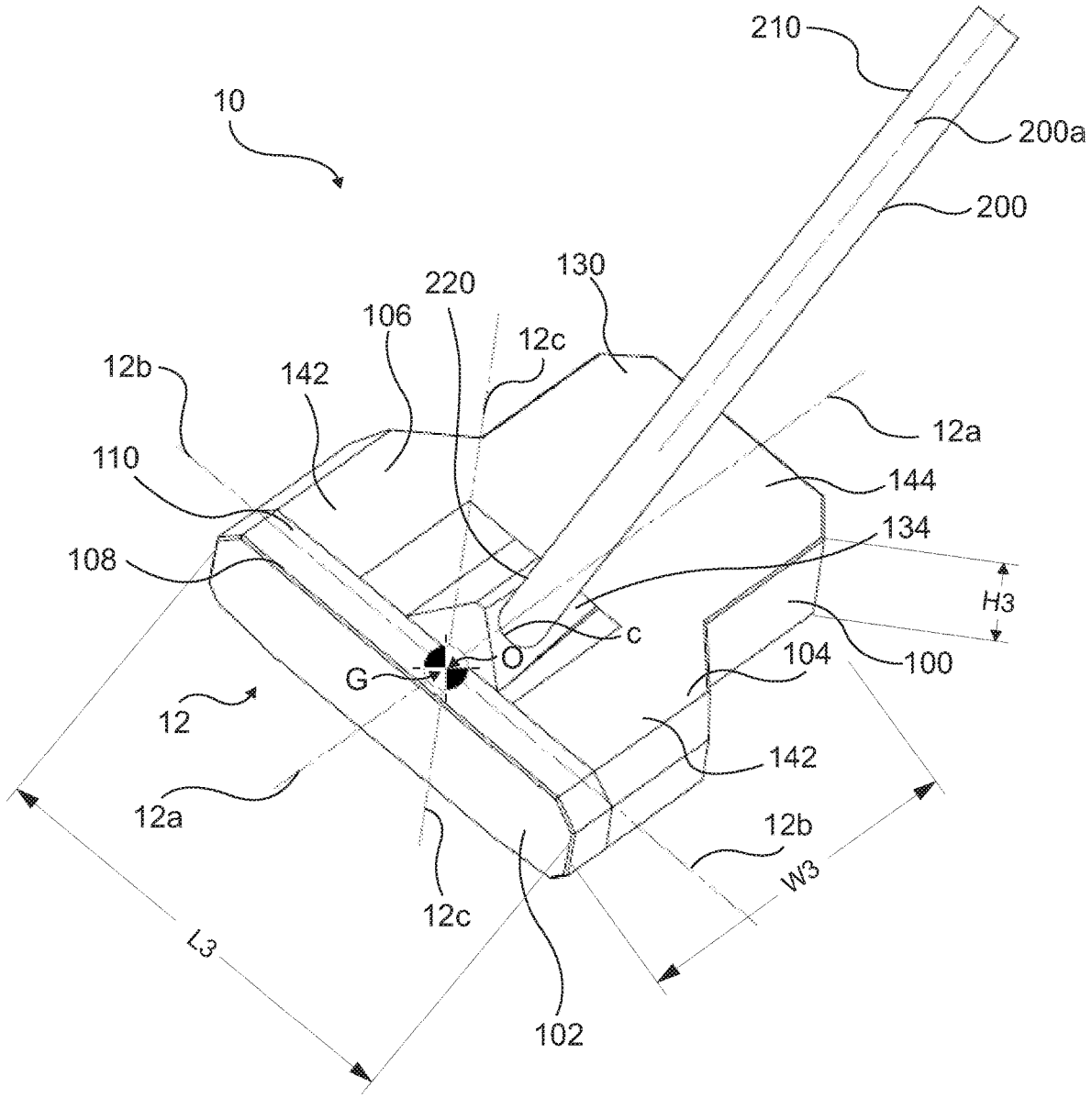
FIG. 9 illustrates a perspective view of an exemplary golf putter, in accordance with a third embodiment of the present disclosure.
Figure 10:
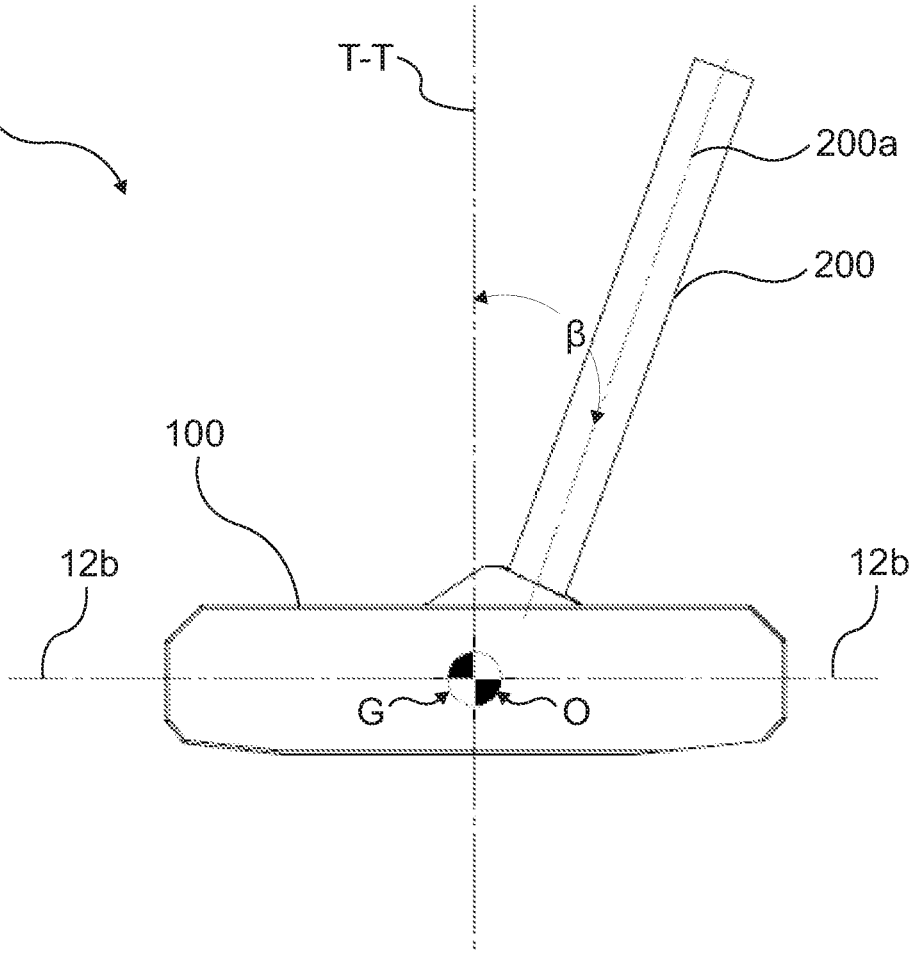
FIG. 10 is a front view of the golf putter of FIG. 9, in accordance with an embodiment of the present disclosure.
Figure 11:
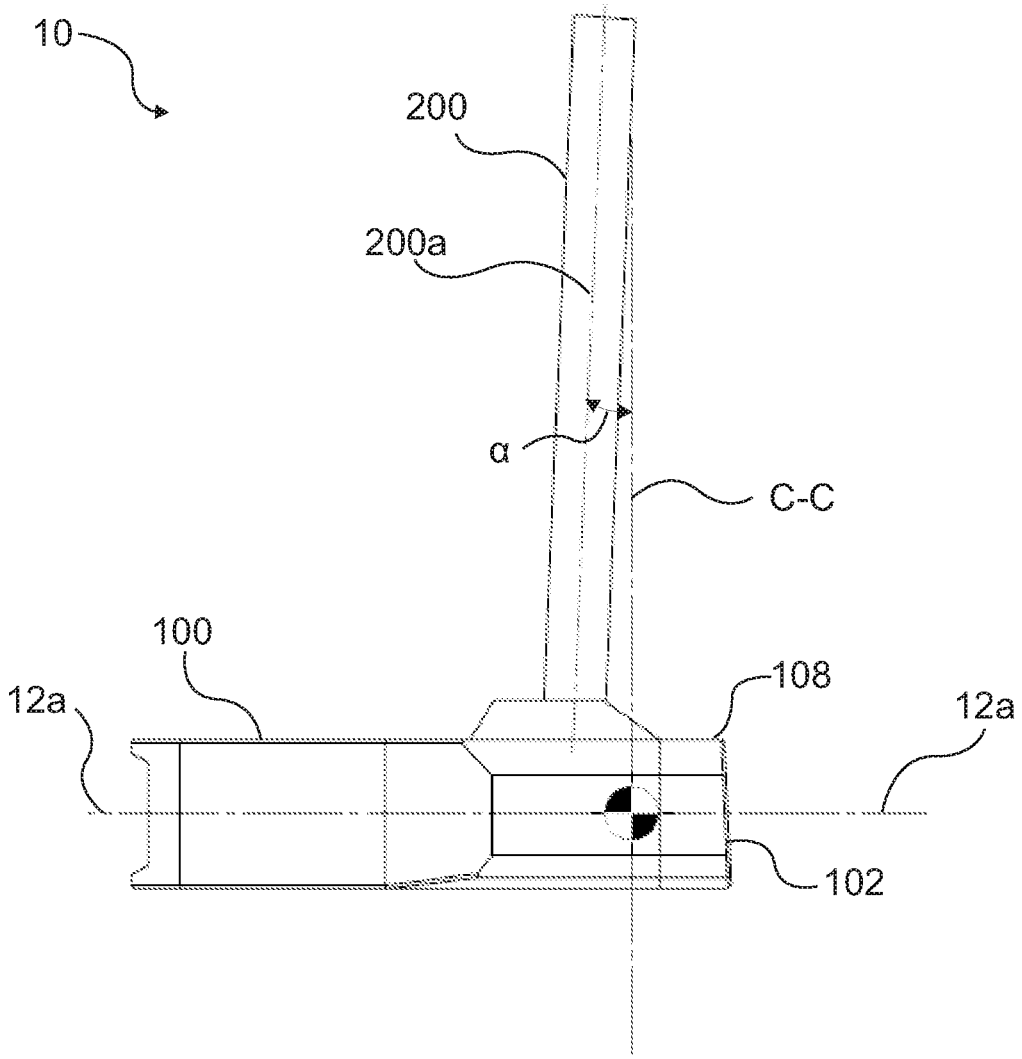
FIG. 11 is a side view of the golf putter of FIG. 9, in accordance with an embodiment of the present disclosure.

In accordance with a third exemplary embodiment of the present disclosure, referring to FIGS. 9, 10 and 11, the second part 130 of the putter head 100 may comprise a structure that is formed in the shape of a 'tuning fork' that comprises two legs 142 connected to each other via a block 144. Each of the two legs 142 may define a respective blind hole 132 therein. Said blind holes 132 facilitates press-fitting the connecting pins 150 with the second part 130 such that the second part 130 may be coupled with the first part 110 of the putter head 100. According to the said third exemplary embodiment, a size, material, and a mass of each of the first part 110, the second part 130 and the connecting pins 150, and the contact point 'C' at the putter head 100 are so selected that upon coupling the second part 130 to the first part 110 and the shaft 200 to the putter head 100, the center of gravity 'G' of the putter head 100 lies between the contact point 'C' and the putter face 102.

In accordance with the third exemplary embodiment, referring to FIG. 9, a length 'L3' of the putter head 100 may vary within the range of 50 mm to 125 mm, a width 'W3' of the putter head 100 may vary within the range of 30 mm to 120 mm and a height 'H3' of the putter head 100 may vary within the range of 15 mm to 45 mm. In a specific embodiment, the length 'L3' of the putter head 100 is 95 mm, the width 'W3' of the putter head 100 is 90 mm and the height 'H3' of the putter head 100 is 24 mm. Also, in said embodiment, the second part 130 comprises a 'pyramidical' connecting element 134 disposed between the two legs 142 of the 'tuning fork' to couple the bottom end 220 of the shaft 200 with the second part 130 of the putter head 100 at the contact point 'C'.

The golf putter 10 and the putter head 100 of the present disclosure possess the properties that overcomes the technical problems identified in the conventional/known golf putters. The golf putter 10 and the putter head 100 of the present disclosure are center shafted, forward press (i.e., the shaft 200 leans forward towards the target/golf ball and up to or beyond the putter face 102 of the putter head 100), heavily front weighted (the majority weight/mass of the putter head 100 is ahead of the shaft 200/contact point 'C'), a face down or sky dive when held parallel to the ground and with the shaft 200 attached to the putter head 100 via the pyramidical or a cylindrical connecting element 134 at an angle to the putter face 102.

Contrary to the typically known 'face up' golf putters, the golf putter 10 of the present disclosure is a 'face down' golf putter 10, i.e., when the shaft 200 of the golf putter 10 is balanced on the finger keeping the shaft 200 parallel to the ground, the putter head 100 faces towards the ground or away from the sky.

The above recited configuration of the golf putter 10 and the putter head 100 along with a combination of various design and physical factors, balance and choice of materials results in certain properties in the putter head 100 that while not creating a 'larger sweet spot' result in the putter flowing on a more correct plane or arc which results in an easier stroke to strike the golf ball. The sweet spot may be understood as an area on the putter face 102 where impact produces little or no vibration. The golf putter 10 of the present disclosure performs in such a way that the said golf putter 10 creates an inertia that makes the golf putter 10 stay on a plane or arc to deliver the face square at impact.

The various embodiments of the present disclosure have been described above with reference to the accompanying drawings. The present disclosure is not limited to the illustrated embodiments; rather, these embodiments are intended to fully and completely disclose the subject matter of the disclosure to those skilled in this art. In the drawings, like numbers refer to like elements throughout. Thicknesses and dimensions of some components may be exaggerated for clarity.

Herein, the terms "attached", "connected", "interconnected", "contacting", "mounted", "coupled" and the like can mean either direct or indirect attachment or contact between elements, unless stated otherwise.

Well-known functions or constructions may not be described in detail for brevity and/or clarity. As used herein the expression "and/or" includes any and all combinations of one or more of the associated listed items.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises", "comprising", "includes" and/or "including" when used in this specification, specify the presence of stated features, operations, elements, and/or components, but do not preclude the presence or addition of one or more other features, operations, elements, components, and/or groups thereof.

While considerable emphasis has been placed herein on the particular features of this disclosure, it will be appreciated that various modifications can be made, and that many changes can be made in the preferred embodiments without departing from the principles of the disclosure. These and other modifications in the nature of the disclosure or the preferred embodiments will be apparent to those skilled in the art from the disclosure herein, whereby it is to be distinctly understood that the foregoing descriptive matter is to be interpreted merely as illustrative of the disclosure and not as a limitation.

REFERENCE NUMERALS

| PARTICULARS | REFERRAL NUMERAL |
|---|---|
| Golf Putter | 10 |
| Cartesian Coordinate System | 12 |
| x-axis | 12a |
| y-axis | 12b |
| z-axis | 12c |
| Putter Head | 100 |
| Putter Face | 102 |
| Rear Face | 102' |
| Heel End | 104 |
| Toe End | 106 |
| Top Edge | 108 |
| First Part | 110 |
| Second Part | 130 |
| Face | 131 |
| Blind Holes | 132 |
| Connecting Element | 134 |
| Hole | 134' |
| Legs | 136 |
| Bridging Member | 138 |
| Cuboidal Block | 140 |
| Legs | 142 |
| Block | 144 |
| Connecting Pins | 150 |
| Shaft | 200 |
| Longitudinal Axis | 200a |
| Top End | 210 |
| Bottom End | 220 |
| Origin | O |
| Center of Gravity | G |
| Contact Point | C |
| Length | L1 |
| Width | W1 |
| Height | H1 |
| Length | L2 |
| Width | W2 |
| Height | H2 |
| Length | L3 |
| Width | W3 |
| Height | H3 |
| Forward Press Angle | α |
| Lie Angle | β |
| Central Plane | C-C |
| Vertical Plane | V-V |
| Transverse Plane | T-T |

EQUIVALENTS

The embodiments herein and the various features and advantageous details thereof are explained with reference to the non-limiting embodiments in the description. Descriptions of well-known components and processing techniques are omitted so as to not unnecessarily obscure the embodiments herein. The examples used herein are intended merely to facilitate an understanding of ways in which the embodiments herein may be practiced and to further enable those of skill in the art to practice the embodiments herein. Accordingly, the examples should not be construed as limiting the scope of the embodiments herein.

The foregoing description of the specific embodiments will so fully reveal the general nature of the embodiments herein that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. Therefore, while the embodiments herein have been described in terms of preferred embodiments, those skilled in the art will recognize that the embodiments herein can be practiced with modification within the spirit and scope of the embodiments as described herein.

Any discussion of documents, acts, materials, devices, articles and the like that has been included in this specification is solely for the purpose of providing a context for the disclosure. It is not to be taken as an admission that any or all of these matters form a part of the prior art base or were common general knowledge in the field relevant to the disclosure as it existed anywhere before the priority date of this application.

The numerical values mentioned for the various physical parameters, dimensions or quantities are only approximations and it is envisaged that the values higher/lower than the numerical values assigned to the parameters, dimensions or quantities fall within the scope of the disclosure, unless there is a statement in the specification specific to the contrary.

What is claimed is:

1. A golf putter, comprising: a putter head, comprising a toe end and a heel end;

a putter face adapted to strike a golf ball;

a first part made of a first material and having a first mass;

a second part made of a second material and having a second mass;

and a pair of connecting pins made of the first material, wherein the second part is coupled to the first part via the pair of connecting pins such that the putter head defines a center of gravity of the putter head in a central plane that is parallel to a vertical plane containing the putter face and that passes through the pair of connecting pins; and a shaft having a top end and a bottom end, wherein, the bottom end of the shaft is coupled to the second part of the putter head at a contact point that lies between the toe end and the heel end of the putter head and that lies behind the center of gravity of the putter head with reference to the putter face, and the top end of the shaft is inclined towards the vertical plane.

2. The golf putter as claimed in claim 1, wherein a longitudinal axis of the shaft defines a forward press angle with respect to the central plane, the forward press angle is within the range of 1 to 4 degrees.

3. The golf putter as claimed in claim 2, wherein the longitudinal axis of the shaft is inclined towards the heel end of the putter head and defines a lie angle with respect to a transverse plane that is perpendicular to the central plane, the lie angle is within the range of 67 to 79 degrees.

4. The golf putter as claimed in claim 1, wherein the contact point is defined mid-way between the toe end and the heel end of the putter head.

5. The golf putter as claimed in claim 1, wherein the center of gravity is defined between the putter face and the contact point.

6. The golf putter as claimed in claim 1, wherein the putter head further comprises a connecting element for coupling the shaft of the golf putter to the putter head of the golf putter.

7. The golf putter as claimed in claim 1, wherein the pair of connecting pins press-fits into corresponding holes defined in the first part and the second part of the putter head.

8. The golf putter as claimed in claim 1, wherein the central plane is proximal to the first part of the putter head than the contact point of the shaft and the putter head.

9. The golf putter as claimed in claim 1, wherein the central plane passes through the first part of the putter head.

10. The golf putter as claimed in claim 1, wherein the top end of the shaft extends up to a top edge of the putter face of the putter head.

11. The golf putter as claimed in claim 1, wherein the top end of the shaft extends beyond a top edge of the putter face of the putter head.

12. The golf putter as claimed in claim 1, wherein the first part and the pair of connecting pins of the putter head are made of steel, brass or copper; and the second part of the putter head is made of aluminum or plastic.

13. The golf putter as claimed in claim 1, wherein the second part comprises two columnar legs connected to each other via a bridging member, the bridging member adapted to be coupled to the first part, wherein the second part is coupled to the first part such that the center of gravity of the putter head lies between the contact point and the putter face.

14. The golf putter as claimed in claim 13, wherein a length of the putter head is within the range of 50 mm to 125 mm, a width of the putter head is within the range of 30 mm to 120 mm and a height of the putter head is within the range of 15 mm to 45 mm.

15. The golf putter as claimed in claim 1, wherein the second part is formed in the shape of a tuning fork comprising two columnar legs, the two columnar legs adapted to be coupled to the first part, wherein the second part is coupled to the first part such that the center of gravity of the putter head lies between the contact point and the putter face.

16. The golf putter as claimed in claim 15, wherein a length of the putter head is within the range of 50 mm to 125 mm, a width of the putter head is within the range of 30 mm to 120 mm and a height of the putter head is within the range of 15 mm to 45 mm.

* * * * *